United States Patent [19]

Heliot

[11] 4,356,602

[45] Nov. 2, 1982

[54] STRETCHER FOR KNITTED FABRICS

[75] Inventor: Daniel Heliot, La Chapelle Saint Luc, France

[73] Assignee: Etablissements Maurise Heliot SA, La Chapelle Saint Luc, France

[21] Appl. No.: 87,348

[22] Filed: Oct. 23, 1979

[30] Foreign Application Priority Data

Oct. 22, 1979 [FR] France ..... 79 26131

[51] Int. Cl.[3] ..... D06C 5/00

[52] U.S. Cl. ..... 26/84

[58] Field of Search ..... 26/80, 81, 84, 83, 85; 264/290.2

[56] References Cited

U.S. PATENT DOCUMENTS 3,508,286 4/1970 Rosen ..... 26/80 X 4,192,045 3/1980 Frezza ..... 26/84 X

FOREIGN PATENT DOCUMENTS 49-6543 2/1974 Japan ..... 26/85

940339 10/1963 United Kingdom ..... 26/85

*Primary Examiner*—Robert Mackey

*Attorney, Agent, or Firm*—Wolf, Greenfield & Sacks

[57] ABSTRACT

A stretcher for tubular knitted fabric aimed at being mounted onto a calender and carrying two stretcher arms each carrying positioning rollers co-operating with supplier rollers for pulling up the knitted fabric and making it pass through said stretcher. Both arms are connected to one another in their median area by a pneumatic jack for the adjustment of the spreading of said stretcher.

9 Claims, 6 Drawing Figures

Fig : 2
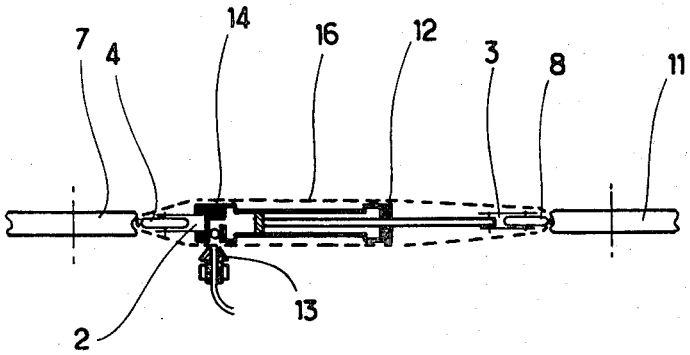
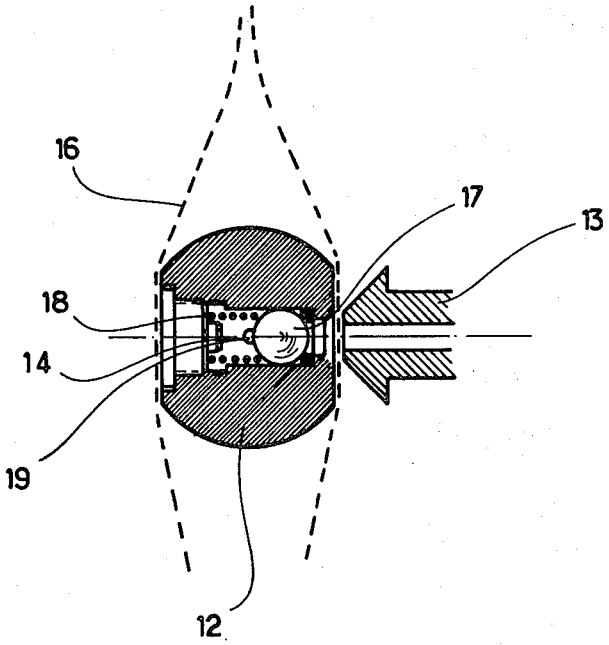
Fig : 3

STRETCHER FOR KNITTED FABRICS

The invention relates to a stretcher for tubular knitted fabric aimed at being mounted onto a calender for processing knitted fabric. Also, such a stretcher can be mounted at the outlet of a squeezing device, at the inlet of a dryer or on any other machine for processing tubular knitted fabric.

Stretchers for tubular knitted fabric carrying two arms are already known, which are connected to one another by two bars sliding inside each other, a clamping bolt being provided for locking the bars depending on the spacing selected by the user.

Traditional stretchers show a major drawback for it is necessary to take out the tubular knitted fabric from the stretcher for adjusting the spacing between the arms.

The present invention is aimed at providing a stretcher for tubular knitted fabric being simply conceived, easily mounted and capable of adjustment without previously withdrawing the knitted fabric passing through the stretcher, permitting modification of the width of the knitted fabric further to the positioning of said knitted fabric in said stretcher without it being necessary to take off the latter and leaving no mark on the knitting.

To this end, the invention provides a stretcher for tubular knitted fabric aimed at being mounted onto a calender and carrying two stretcher arms each carrying positioning rollers co-operating with supplier rollers for pulling up the knitted fabric and having it pass through the stretcher. Both arms are connected to one another by a pneumatic jack in the median area of said arms so as to permit the adjustment of the spacing of said stretcher.

According to a further characteristic feature of the invention, the feeding source of the jack consists of a nozzle external to said jack and positioned opposite the latter, the compressed air being injected into said jack through the knitted fabric passing in the stretcher.

According to a further characteristic, the invention relates to a stretcher for tubular knitted fabric aimed at being mounted onto a calender and comprising two stretcher arms each carrying positioning rollers co-operating with supplier rollers for pulling up the knitted fabric and making it pass through the stretcher whose stretcher arms are connected to one another by means of a pneumatic jack in the median area of said arms for the adjustment of the spacing of said stretcher. The jack carries a locking device permitting the spreading of said jack and the spacing of the arms of said stretcher, but preventing any opposite motion from occuring. The locking device remains locked as long as there is no pressure greater than the determined threshold in the jack.

According to a further characteristic, the invention provides an unidirectional locking device consisting of a ramp integral with the cylinder at a certain distance from the piston rod so as to form a space designed to receiving a locking roller and to wedging said roller for a relative motion in one direction between the rod and the cylinder of the jack.

According to a further feature, the invention provides a locking roller supported at least by an arm hinged on the support, said arm being connected to a locking device.

According to a further feature of the invention, the locking device consists of a pneumatic jack whose piston rod is connected to an arm of said locking device, the motive fluid feeding the piston acting in the locking direction, a return-spring operating in the reverse direction thus defining the threshold of the pressure required for performing unlocking.

Thus, it is possible to make the spacing of the stretcher vary without it being necessary to this end to dismount the stretcher arms. Also, this makes it possible to work continuously and process tubular knitted fabrics of different size without stopping the traveling of said knitted fabrics: it then suffices when a knitted fabric is ending and the following one starting to operate the automatic spacing of the supplier rollers and of the stretcher. In case the width would be increased, the supplier rollers move apart from one another and at the same time the compressed air acting onto the jack spreads the stretcher.

In case the width is reduced when the pressure in the jack is over the threshold fixed by the locking spring or the spring of the valve, the compressed air opens the valve of the jack or unlcoks said jacks and the supplier rollers push the supporting rollers so as to reduce the width of the stretcher accordingly. Besides, as it occurs in the case where the jack carries locking means, the chamber of the jack is not closed when the injector does not work. As a result, the rod of the piston is subjected to no force tending to spread the stretcher. The knitted fabric is only slightly compressed between the supplier and supporting rollers which removes any mark made by said rollers or smoothing of said knitted fabric. This is particularly of importance when fragile products are involved.

The present invention will be better understood by means of the two modes of embodiment of a stretcher for tubular knitted fabric diagrammatically shown by way of non-limitative examples in the attached drawings, wherein:

FIG. 2 is a cross-section view from above of the stretcher shown in FIG. 1.

FIG. 3 is a side cross-section view of a detail of the jack of the stretcher.

Figure 1:
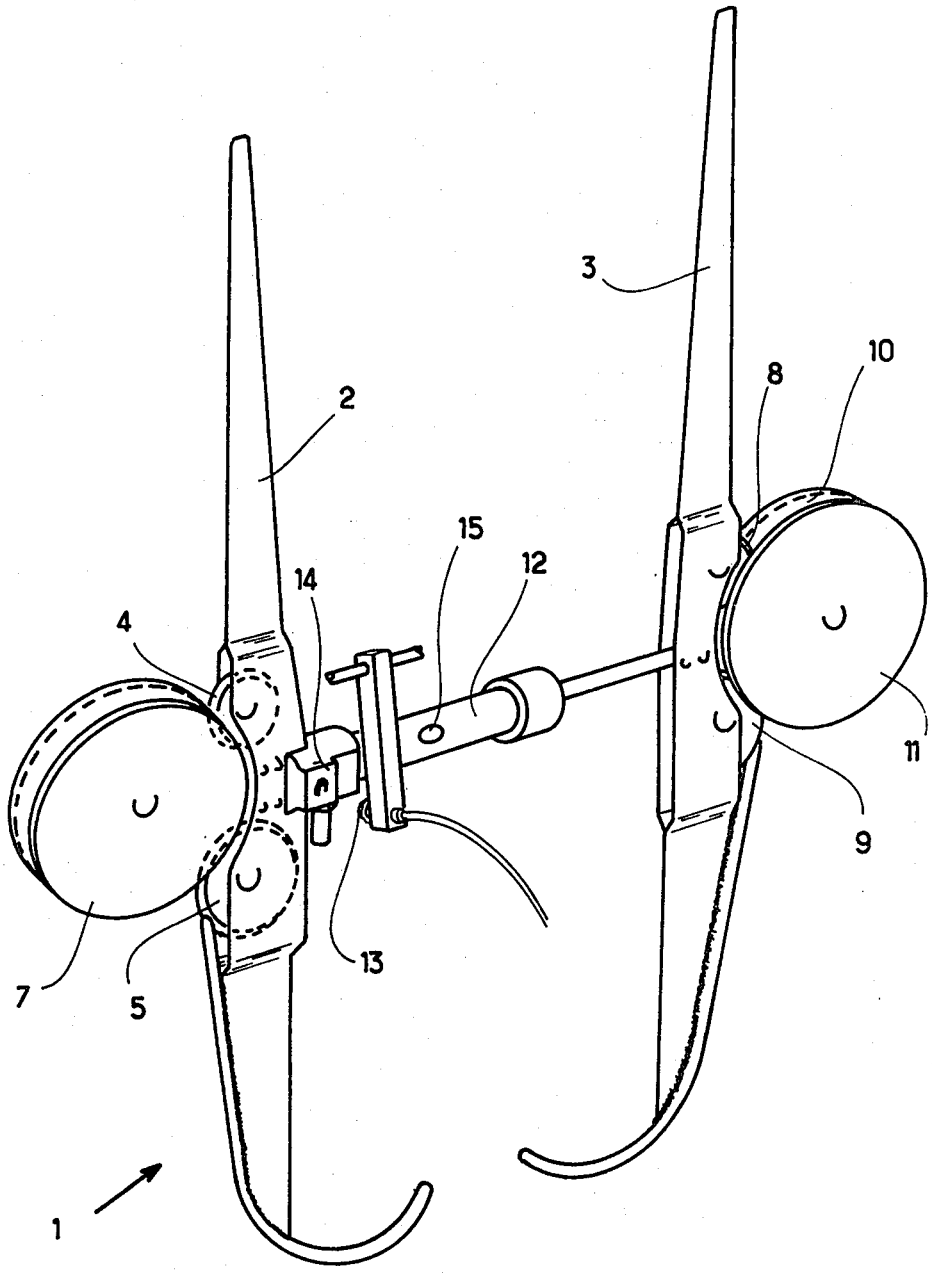
FIG. 1 is a perspective view of the stretcher according to a first mode of embodiment.

as shown in FIG. 1, the stretcher 1 carries stretcher arms 2, 3. The arm 2 carries two supporting rollers 4, 5 applied against the bottom of the groove of the supplier roller 7.

Also, the stretcher arm 3 carries supporting rollers 8, 9 applied against the bottom of the groove 10 of the supplier roller 11. The supplier rollers 7 and 11 are fitted onto the calender (not shown) and can be adjusted so as to move apart from or draw near to one another depending on the nature and size of the knitted fabric to be made.

The stretcher arms 2 and 3 are connected to each other on a level with their median area between the supporting rollers 4, 5 and 8, 9 by a pneumatic jack 12. Said pneumatic jack 12 is aimed at applying the stretcher arms 2, 3 against the supplier rollers 7, 11 through the supporting rollers 4, 5 and 8, 9. The pneumatic jack 12 is fed by a feeding nozzle 13 external to said jack and positioned opposite the ball-valve 14.

Thus, it is possible to arrange the tubular knitted fabric on the arms of the stretcher, said knitted fabric running between the supplier rollers 7, 11 and the supporting rollers 4, 5 and 8, 9, as well as before the feeding nozzle 13 supplying compressed air.

The pneumatic jack 12 is fed through the knitted fabric 16, to keep it in position when the stretcher arms 2, 3 are moved apart from or drawn near to one another.

So as to adjust the space between the stretcher arms 2, 3, it suffices to move the supplier rollers 7, 11 movable in translation, either by hand, or automatically. When said operations are performed, the stretcher arms 2, 3 are kept applied against the supplier rollers. However, a pivoting and foldable supporting nose is provided on the calender under the jack so as to take charge of the latter till the arms, when spcing operations are performed, be again sufficiently applied against the supplier rollers.

When the supplier arms are adjusted, the feeding nozzle 13 is moved aside the ball-valve 14 and, thereby, the jack 12 is no longer fed with compressed air. It is then possible to start the calender for processing the knitted fabric. The compressed air inside the jack remains under pressure for over several hours thanks to the ball-valve 14.

Also, a safety-valve 15 is provided on the body of the jack 12 so as to keep the pressure inside the jack constant when the stretcher arms 2, 3 are drawn near to one another so as to reduce the space between them.

As shown in FIG. 2, the view from above of the stretcher permits to better appreciate the positioning of the knitted fabric 16 running on the one hand between the supporting rollers 4, 5 and the supplier roller 7 and, on the other between the supporting rollers 8, 9 and the supplier roller 11. In addition, the knitted fabric 16 is running between the nozzle 13 positioned opposite the ball-valve 14. In such a positioning, the compressed air is injected from the nozzle 13 into the body of the jack 12 by removing the ball. Said injection of compressed air corresponds to a spacing motion, the arms 2, 3 moving apart from each other. When the spacing between the arms is adjusted, the nozzle 13 is moved apart from the valve 14 and the calander is started for processing the knitted fabric.

As shown in FIG. 3, the positioning of the nozzle 13 in relation to the ball-valve 14, also illustrates the possibility of injecting compressed air into the body of the jack 12 by removing the ball 17 through the action of the spring 18 so as to let the compressed air penetrate through the boring 19 into the body of the jack 12. The injection of compressed air into the jack 12 corresponds to a spacing motion between the arms 2, 3. The adjustment of the space between the arms 2, 3 is performed without it being necessary to take out the tubular knitted fabric 16 running between the nozzle 13 and the valve 14.

For the description of the second mode of embodiment, the same numeral and literal references as above will be used for designating the same elements, the description of which will not be made.

Figure 4:
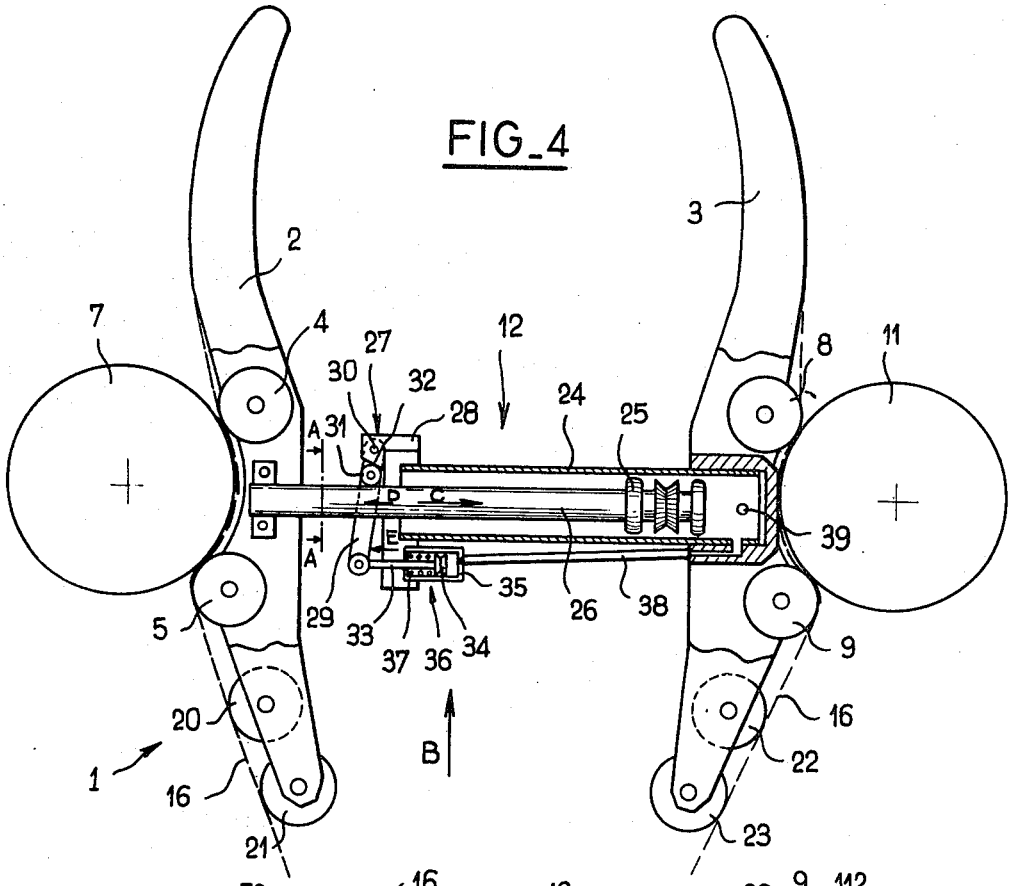
FIG. 4 is a diagrammatical front view of a stretcher according to a second mode of embodiment, mounted between two supplier rollers, some parts of said stretcher being shown in cross-section.

As shown in FIG. 4, the stretcher 1 provided by the invention is designed to be positioned between two supplier rollers 7, 11 so as to stretch the knitted fabric 16 which is diagrammatically shown by its two edges in said FIG. 4.

The stretcher consists of two stretcher arms 2, 3 symmetrical in relation to the axis of the Figure; both said stretcher arms 2, 3 are, except some details, almost identical to one another.

The stretcher arm 2 carries two supporting rollers 4, 5 rolling along the roller 7 and inside the groove of said roller 7, should the latter have a groove.

The running direction of the knitted fabric being shown by arrow B, the stretcher arm 2 carries two rolling rollers 20, 21 upstream on which the knitted fabric firstly rests before running between the supplier roller 7 and the supporting rollers 4, 5 as far as the left part of the FIG. 1 is concerned.

The stretcher arm 3 shown at the right of FIG. 1 is achieved in the same manner; it carries two supporting rollers 8, 9 co-operating with the supplier roller 11, as well as two rollers 22, 23 positioned upstream playing the same function as the rollers 20, 21 of the stretcher arm 2.

As shown in FIG. 4, the stretcher arms 2 consist of two sides made of iron or the like having the same shape and carrying the axes of the rollers 4, 5, 20, 21 for the arm 2 and rollers 8, 9, 22, 23 for the arm 3.

The arms 2, 3 of the stretcher are connected to a pneumatic jack 12. Pneumatic jack 12 consists of a cylinder 24 wherein a piston 25 integral with a piston rod 26 slides. Cylinder 24 is integrally fitted to the arm 3 and the rod 26 is integral with the arm 2. A locking device 27 integral with the cylinder 24 is provided at the outlet of the cyliner 24. Unidirectional locking device 27 is aimed at co-operating with the piston rod 26 so as to prevent under certain conditions said piston rod from moving in the direction of arrow C, that is the withdrawal motion of the piston rod of the jack 12.

The locking device 27 consists of a support 28 connected to the cylinder 24. Support 28 carries an arm 29 hinged about the support 28 about the axis 30. Arm 29 may possibly be double so as to come at each side of the piston rod 26. The arm 29 carries a locking roller 31 mounted with a certain clearance about its axis supported by the arm 29. Also, the clearance of said roller 31 can be obtained by fitting the axis thereof with clearance in the corresponding bearings achieved in the arm 29.

The roller 31 is aimed at co-operating with a locking ramp 32 integral with the support 28. Ramp 32 forms a sharp angle, or sharp dihedral angle, with the upper surface of the piston rod 26; the roller 31 can lock in said dihedral angle when, driven by its rolling along the rod of the piston 26 which moves in the direction of arrow C, said roller 31 also tends to move in the direction of arrow C.

The end of the arm 29 opposite the end of the hinge 30 is connected to the rod 33 of a piston 34 housed inside the cylinder 35 of a locking jack 36. The motion of the rokd 33 of the piston in the direction of arrow E is operated by the motive fluid introduced into the chamber of the jack 36; the motion opposite the direction of arrow E is operated by the return-spring 37. The cylinder 35 of the jack 36 is integral with the cylinder 24 of the jack 12.

The chamber of the jack 36 is connected to the chamber of the jack 12 by a pipe 38, said chamber itself carrying a feeding aperture 39.

Figure 5:
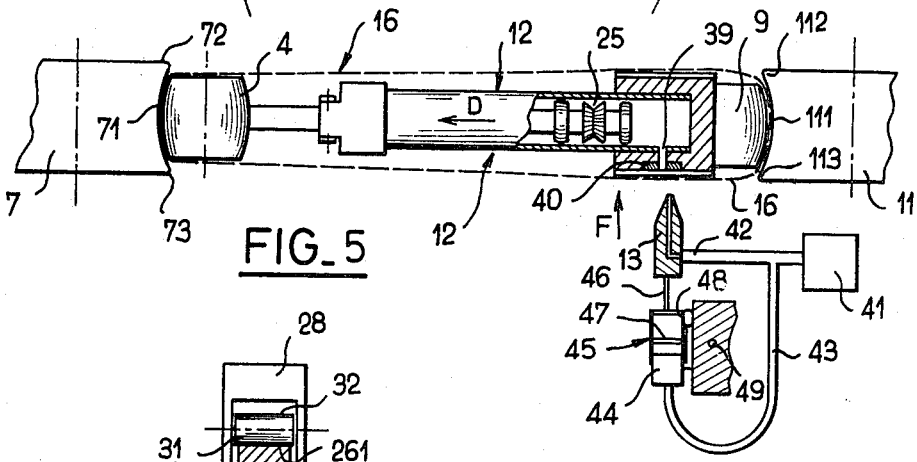
FIG. 5 is a view from above corresponding to FIG. 4, and showing part of the device cut away.

The view from above of FIG. 5 shows how the supporting roller 4, relatively broad, the width of which is of 50mm for example, is resting in the groove whose width is the same as that of the supplier roller 7; said groove 71 of the roller 7 is delimited by two flanges 72, 73 preventing the roller 4 from escaping the groove. The right end of FIG. 5 shows the supporting roller 9 co-operating with the supplier roller 11. Also, the part cross-section view of FIG. 5 shows the feeding aperture 39 of the chamber of the jack 12. As shown in FIG. 5, the feeding apparatus 39 is delimited at its inlet by a resilient joint 40 so as to facilitate the positioning of the feeding nozzle 13.

As provided by the improvement, the feeding nozzle 13 is fed with compressed air supplied by the source of compressed air 41 through a flexible pipe 42. Flexible pipe 42 carries a diversion 43 connected to the chamber 44 of a jack 45 whose rod 46 of the piston 47 is integral with the nozzle 13. The cylinder 48 of the jack 45 is integrally supported by the framework 49, diagrammatically shown.

Figure 6:
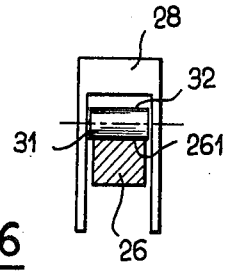
FIG. 6 is a cross-section view of the stretcher along A—A of FIG. 4.

The part cross-section view of FIG. 6 shows an example of a mode of embodiment of a piston rod 26 square or rectangular-shaped. The upper surface 261 of the rod 26 co-operates with the locking roller 31 which itself rests on the ramp 32 of the support 28.

The stretcher described hereabove works as follows:

When the stretcher is dismounted, the piston 25 is driven into the cylinder 24 of the jack 12. Then, the stretcher can easily be positioned inside the knitted fabric tube 16, then position the whole so that the supporting rollers 4, 5 and 8, 9 are respectively positioned opposite the supplier rollers 7, 11. Then, the source of compressed air 41 is operated and the latter sends an impulse of air inside the flexible pipe 42. Impulse of air divides into one part which escapes the nozzle 13 and one part which runs inside the diversion pipe 43 for operating the motion of the piston 45 inside its cylinder 48 causing the motion of the nozzle 13 in the direction of arrow F so that said nozzle is positioned opposite the feeding aperture 39; the compressed air supplied by the nozzle 3 passes through the knitted fabric 16 which covers the aperture 39. The air thus injected into the jack 12 repels the piston 25 in the direction of arrow D and applies the rollers 4, 5 and 8, 9 at both sides of the respective supplier rollers 7, 11 which are then standing in the position clearly shown in FIG. 4.

As the pressure of the compressed air which is in the chamber of the jack 12 is also transmitted by the pipe 38 to the chamber of the jack 36, said pressure operates the motion of the piston rod 33 in the direction of arrow E, causing the arm 29 to swing and then the release of the roller 31. It is only when said roller 31 is no longer locked between the ramp 32 and the upper surface of the piston rod 26 that the force developed by the pressure acting upon the piston 25 is sufficient for repelling the rod 26 in the direction of arrow D for developing the jack and applying the supporting rollers 4, 5 against the supplier roller 7 and the rollers 8, 9 against the supplier roller 11.

When the sending of compressed air is stopped, a return means such as a spring (not shown) moves again the nozzle 13 apart from the aperture 39.

When there is no longer any feeding of compressed air through the nozzle 13, the compressed air of the chamber of the jack 12 escapes through the aperture 39 till the pressures are equal to each other. As the pressure which then is inside the chamber of the jack 36 vanishes, the return-spring 37 repels the piston 34 and the rod 33 in the opposite direction of arrow E; this motion results in a rotation of the arm 29 about its axis 30, which puts the roller 31 in contact with the ramp 32 and the upper surface of the piston rod 26. This motion associated with a small backward motion (in the direction of arrow C) of the piston 25 and of the rod 26, suffices to wedge the roller 31 between the ramp 32 and the rod 26, which consequently locks the rod 26 and prevents it from moving in the direction of arrow C. Thus, the rollers 4, 5 and 8, 9 respectively remain applied against the rollers 7, 11.

The air under pressure escapes the chamber of the jack 12 through the aperture 39. The piston 25 can be released in the direction of arrow C only by a small length since it drives through its motion the roller 31 which then wedges within the space defined by the upper surface of the piston rod 26 and the ramp 32, by locking the motion of the piston rod 26.

The inclination of the ramp 32 and the size of the roller 31 as well as the nature of the contact surfaces are selected so that the stroke of the piston rod 26 in the direction of arrow C be relatively small and, anyway, so that said stroke does not suffice to permit the supporting rollers 4, 5 and 8, 9 to respectively escape the supplier rollers 7, 11.

Thus, the position of the stretcher is retained during all the working thereof.

When the space between the rollers 7, 11 is modified, the jack 12 is simultaneously adjusted by the source of compressed air without it being necessary to make any further modification. Such an adjustment of the spacing is necessary when the machine is processing knitted fabrics one after another; it then suffices to adjust the spacing to the new width when a further knitted fabric is to be treated.

What I claim is:

1. A stretcher for tubular knitted fabric for mounting onto a calender comprising two stretcher arms, positioning rollers, said stretcher arms each carrying said positioning rollers, driven supplier rollers cooperating with said positioning rollers for pulling up the knitted fabric and making it pass about said stretcher, a pneumatic jack for connecting both stretcher arms at their median area and for the adjustment of the spreading of said stretcher, a feeding source for the jack comprising a nozzle external to said jack and positioned opposite a feeding aperture, compressed air being injected inside the jack through the knitted fabric passing about the stretcher, said jack further comprising a uni-directional locking means whereby the jack may increase the spacing of the arms of the stretcher and any reverse motion is prevented from occurring, said locking means remaining locked as long as there is no pressure other than a predetermined threshold inside the jack.

2. A stretcher for tubular knitted fabric according to claim 1, wherein the unidirectional locking means comprises a body and a ball-valve arranged opposite the nozzle for admitting and retaining the compressed air inside said jack when the stretcher is spread out.

3. A stretcher for tubular knitted fabric according to claim 1, wherein the unidirectional locking means comprises a safety-valve so as to keep a constant pressure inside said jack when the space between the stretcher arms decreases.

4. A stretcher according to claim 1, the jack including a cyinder and a piston in coaxial alignment, a piston rod attached to the piston, the unidirectional locking means comprising, a ramp integral with the cylinder at a certain distance from the piston rod so as to form a clearance space therebetween, a locking roller received in tfhe space and means for controlling movement of said locking roller such that the roller is wedged between the ramp and the rod when the piston moves into the cylinder.

5. A stretcher according to claim 4 wherein the means for controlling movement of the locking roller comprises, a locking roller support, an arm hingedly attached to the support, and connected to the locking means.

6. A stretcher according to claim 5, wherein the locking means comprises, a second pneumatic jack having a second cylinder and a second piston, a second rod attached to said second piston at a first end, compressed air acting on a second end and in the direction of said second rod for locking of the jack, a return spring acting on said second piston and in opposition to said compressed air, said return spring determining the threshold of the pressure required for unlocking of the jack.

7. A stretcher according to claim 6, the locking means further comprising, a conduit connecting the cylinder interior and the second cylinder interior, an injection aperture for compressed air located in the cylinder of the jack freely communicating with the interior.

8. A stretcher for tubular knitted fabric for mounting onto a calender comprising;

two stretcher arms, positioning rollers, said stretcher arms each carrying said positioning rollers, supplier rollers cooperating with said positioning rollers for pulling up the knitted fabric and making it pass about the stretcher, a pneumatic jack in the median area of said arms for adjusting the spreading of the stretcher, a feeding source for the jack comprising a nozzle external to said jack and positioned opposite a feeding aperture, compressed air being injected inside the jack through the knitted fabric passing about the stretcher, the supplier rollers being driven and operating the spreding of the stretcher whose arms are kept applied onto said supplier rollers by the jack, the size of the supplier rollers being relatively large and provided with grooves having a width corresponding to that of the positioning rollers, the grooves being delimited by two flanges, said jack further comprising a uni-directional locking means whereby the jack may increase the spacing of the arms of the stretcher and any reverse motion is prevented from occurring, said locking means remaining locked as long as there is no pressure other than a predetermined threshold inside the jack.

9. A stretcher for tubular knitted fabric for mounting onto a calender comprising two stretcher arms, positioning rollers, said stretcher arms each carrying said positioning rollers, driven supplier rollers cooperating with said positioning rollers for pulling up the knitted fabric and making it pass about said stretcher, a jack for connecting both stretcher arms at their median area and for adjustment of the spreading of said stretcher, a feeding source for the jack and means for selectively feeding compressed air to the jack from the feeding source through the knitting passing about the stretcher, to facilitate selected positioning of the positioning rollers, said jack further comprising a uni-directional locking means whereby the jack may increase the spacing of the arms of the stretcher and any reverse motion is prevented from occurring, said locking means remaining locked as long as there is no pressure other than a predetermined threshold inside the jack.

* * * * *